US005692561A

United States Patent [19]

Kang et al.

[11] Patent Number: 5,692,561

[45] Date of Patent: Dec. 2, 1997

[54] FIN TUBE HEAT EXCHANGER HAVING INCLINED SLATS

[75] Inventors: Tae Wook Kang; Kam Gyu Lee, both of Busan, Rep. of Korea

[73] Assignee: LG Electronics, Inc., Seoul, Rep. of Korea

[21] Appl. No.: 590,321

[22] Filed: Jan. 23, 1996

[30] Foreign Application Priority Data

Jan. 23, 1995 [KR] Rep. of Korea ..... 1995-1078

[51] Int. Cl.[6] ..... F28D 1/04; F28F 1/32

[52] U.S. Cl. ..... 165/151; 165/181

[58] Field of Search ..... 165/151, 181

[56] References Cited

U.S. PATENT DOCUMENTS

| | | | |
|---|---|---|---|
| 4,907,646 | 3/1990 | Aoyagi et al. | 165/151 |
| 5,042,576 | 8/1991 | Broadbent | 165/151 |
| 5,109,919 | 5/1992 | Sakuma et al. | 165/151 |
| 5,509,469 | 4/1996 | Obosu | 165/151 |

FOREIGN PATENT DOCUMENTS

| | | | |
|---|---|---|---|
| 259393 | 10/1988 | Japan | 165/151 |
| 44192 | 2/1990 | Japan | 165/181 |
| 164487 | 6/1993 | Japan | 165/151 |

*Primary Examiner*—Leonard R. Leo

*Attorney, Agent, or Firm*—Birch, Stewart, Kolasch & Birch, LLP

[57] ABSTRACT

A fin tube heat exchanger is used in an air conditioner or the like and includes a plurality of plate-shaped fins at regular intervals in parallel with one another through which air flows, a plurality of heat transfer tubes extending through the plate-shaped fins, and a plurality of cutouts formed in the plate-shaped fins to partially surround the heat transfer tubes. A semicircle-shaped flat portion is formed on the center part of a plurality of the cutouts on the windward side and the leeward side. This arrangement makes it possible to improve the heat exchange performance by arranging a plurality of the cutouts compactly.

5 Claims, 4 Drawing Sheets

FIN TUBE HEAT EXCHANGER HAVING INCLINED SLATS

BACKGROUND OF THE INVENTION

The present invention relates to a heat exchanger which is used in an air conditioner, and more particularly a heat exchanger with high performance by forming a plurality of cutouts having triangular leg portions formed with different or equal windward side angle, to leeward side angle so that it is possible to arrange a plurality of cutouts following circular arc around a heat transfer tube. The air conditioner is developed to be small and thick, and accordingly the heat exchanger as a component has come to be required to possess high performance, improve heat transfer capability and solve noise problem by reducing air flow resistance between the air and fins by working on the fin surfaces.

As shown in FIG. 1, a conventional heat exchanger comprises a plurality of fin collars 2 being enlarged so that a heat transfer tube 3 may be rigidly secured therein on the one side of a plate-shaped fin 1, and a plurality of cutouts (6,7,8,9,10) which have openings defined between a fin base and an air-flowing side (12,13,14,15) on the opposite side of the plate-shaped fin 1 and having triangular leg portions (16,17,18,19,20,21,22,23). In the above described construction, when the air flow A passes between the heat transfer tubes, an area 4*a*, 4*b* called "dead water region" upon which the air flow A hardly exerts any influence appears behind each tube in the direction of the air flow A since a plurality of the cutouts (6,7,8,9,10) have rectangular forms. In operation with the aforementioned configuration, as shown in FIG. 1(A) and FIG. 1(B), there is another problem based on the action of turbulence without air flow through the cutouts in the leeward side since the air through the air-flowing side (12,13,14,15) in the front windward side flows to the fin collar 2 side for heat transfer tube 3 to be secured and the aforementioned air passage is decreased in the air-flowing side (13,14,15) formed in the rear windward side by arranging all the cutouts (6,7,8,9,10) formed on the plate-shaped fin 1 only on the one side or by arranging all the cutouts (6,7,8,9,10) few so that the cutouts (6,7,8,9,10) are highly formed to improve performance of the plate-shaped fin 1.

There is further problem based on the dead water region that cannot become narrower in the rear leeward side since the triangle-typed leg portions (16,17,18,19,20,21,22,23) are arranged in parallel with the direction of the air flow.

There is still further problem based on the heat exchange performance owing to the limitation of the cutout length.

There is still further problem based on the noise since the resistance against the flow on the triangle-typed leg portions (16,17,18,19,20,21,22,23) of the cutouts (8,9,10) on the rear leeward side is concentrated, with the result that it is impossible to uniformly distribute the velocity of the air flow and that the flow is slowed so that turbulence is occurred, which lowers the heat exchange performance but speeds the velocity of the air flow, so eventually the distribution of the velocity is deviated.

Accordingly, in the above mentioned arrangement, it has not been possible for the air flow to reach the cutouts formed on the leeward side because the air could not efficiently contact the cutouts so that turbulence seriously occurred on the surface of the fin collar on the leeward side, with the result that the velocity of the air flow is slowed. Further, the aforementioned conventional heat exchanger is disadvantageous in that the dead water region (4*a*,4*b*) shown in FIG. 3(A) cannot be satisfactorily removed so that the enlargement of the effective fin area is not attained, in that the noise problem is serious owing to the irregular distribution of the velocity of the air flow. Japanese Patent Unexamined Publication No. 57-192794 discloses the improved arrangement trying to solve the above mentioned disadvantage, but could not perfectly solve the disadvantage in the heat exchanger.

SUMMARY OF THE INVENTION

Accordingly, a primary object of the present invention is to provide a heat exchanger with high performance by widening the heat exchange area and by removing the dead water region, which is achieved by distributing the air flowing in and flowing out uniformly through the cutouts, and by lowering the heat resistance of the fin surfaces.

Another object of the present invention is to lower the cutouts by comprising a plurality of cutouts in which the heat exchange area is widened and the dead water region is narrowed so that the uniform distribution of the velocity of the air flow is achieved.

This is attained by adjusting the windward side angle and the leeward side angle differently, or equally, on the basis of the holes through which the heat transfer tubes are inserted so that it is possible to arrange the leg portions partially including the circular arc inserted by the heat transfer tube, following a plurality of the cutouts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are nor limitative of the present invention, and wherein.

DETAILED DESCRIPTION OF THE INVENTION

Preferred embodiment of the present invention is described in detail hereinafter by accompanying drawings.

Figure 1A:
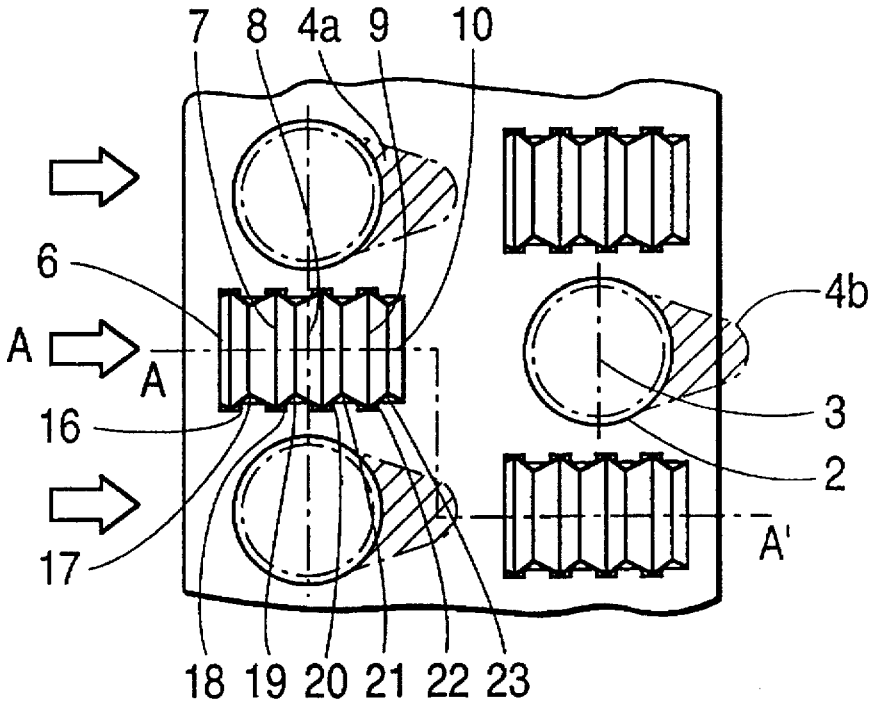
FIG. 1(A) PRIOR ART
FIG. 1(A) is a fragmentary side elevational view of a conventional fin tube heat exchanger.
Figure 1B:
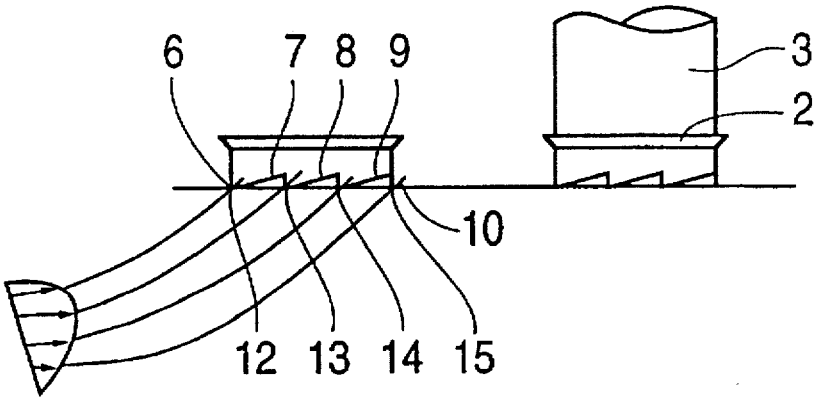
FIG. 1(B) PRIOR ART
FIG. 1(B) is a section taken along the line A–A' in FIG. 1(A)
Figure 2A:
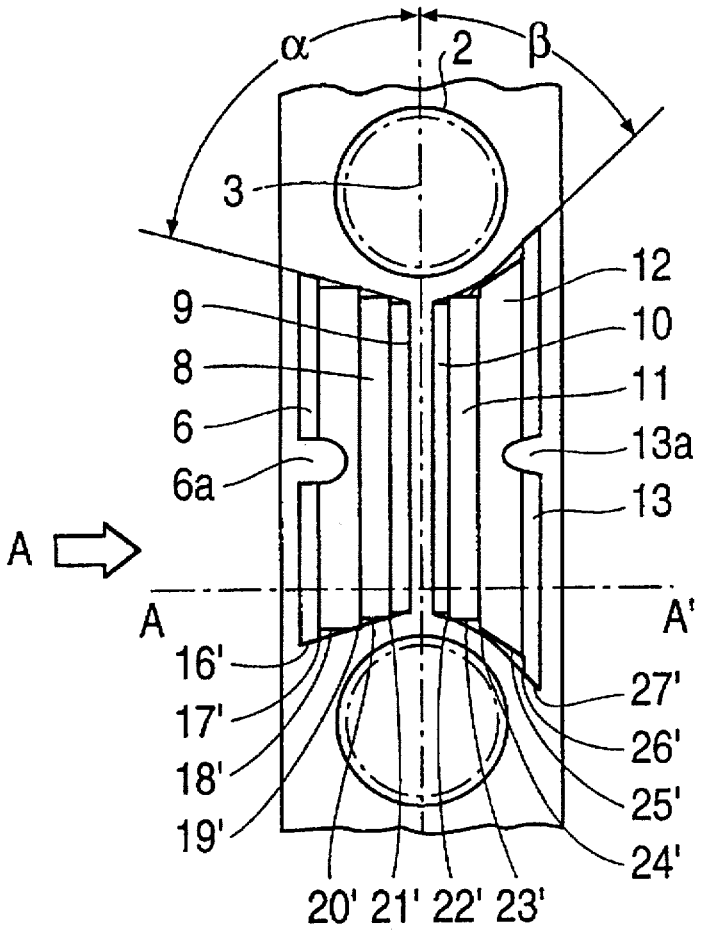
FIG. 2(A) is a fragmentary side elevational view of a fin tube heat exchanger according to one preferred embodiment of the present invention.
Figure 2B:
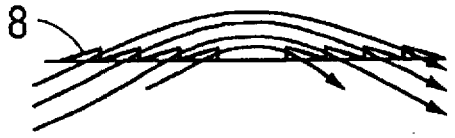
FIG. 2(B) is a section taken along the line A–A' in FIG. 2(A), illustrating the direction of the air flow.
Figure 3A:
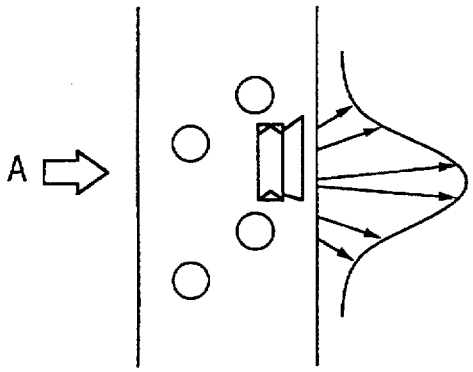
FIG. 3(A) PRIOR ART
FIG. 3(A) is a diagram of distribution of the velocity of the air flow in a conventional fin.
Figure 3B:
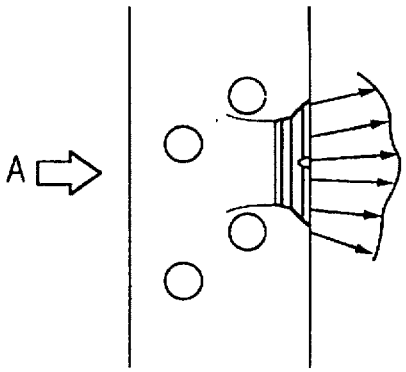
FIG. 3(B) is a diagram of distribution of the velocity of the air flow in a fin of the present invention.
Figure 4:
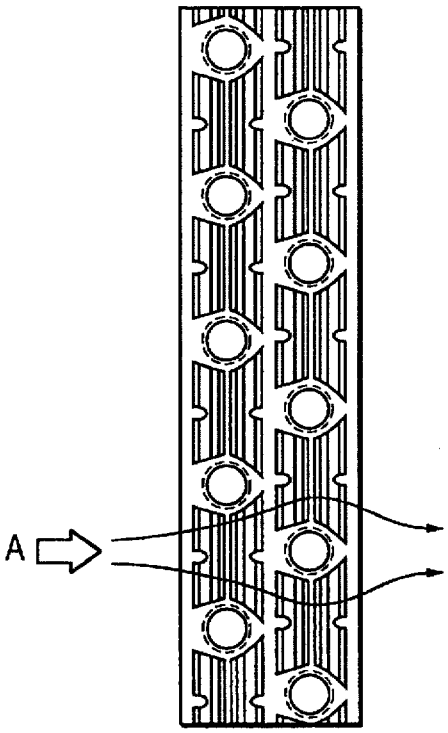
FIG. 4 is top plan view of a heat exchanger embodying the present invention, illustrating a group of cutouts formed in the fin of FIG. 2.

FIG. 2(A) is a fragmentary side elevational view of a fin tube heat exchanger according to one preferred embodiment of the present invention. FIG. 2(B) is a section taken along the line A–A' in FIG. 2(A), illustrating the direction of the air flow. FIG. 3(A) is a diagram of distribution of the velocity of the air flow in a conventional fin. FIG. 3(B) is a diagram of distribution of the velocity of the air flow in a fin of the present invention. FIG. 4 is top plan view of a heat exchanger embodying the present invention, illustrating a group of cutouts formed in the fin of FIG. 2A.

A heat exchanger is internally provided with a plurality of the plate-shaped fins 1 at regular intervals in parallel with one another through which air flows. A plurality of the heat transfer tubes 3 extend through the fins 1, on which a plurality cutouts (6,7,8,9,10,11,12,13) having openings on the air-flowing side in the direction of symmetry about the heat transfer tube 3. A plurality of the leg portions (16', 17', 18', 19', 20', 21', 22', 23', 24', 25', 26', 27') of the cutouts partially surround a circular arc following the contour of the heat transfer tube 3, with the windward side angle(α) and leeward side angle(β) being different or equal. Further, a semicircle-shaped flat portion 6*a* is formed on the center part of a plurality of the cutouts (6,7) on the windward side, and a semicircle-shaped flat portion 13*a* is formed on the center part of a plurality of the cutouts (12,13) on the leeward side.

The operation and effects of the present invention will become more apparent from the following description taken in conjunction with the preferred embodiment thereof with reference to the accompanying drawings, throughout which like parts are designated by like reference numerals.

The leg portions (16', 17', 18', 19', 20', 21', 22', 23', 24', 25', 26', 27') are formed by adjusting the windward side angle(α) and the leeward side angle(β) differently or equally and arranging on the line connecting the circular arc having the center line of the heat transfer tubes 3 so that it is possible to widen the arranged cutouts (6,7,8,9,10,11,12,13) area and in addition to increase the heat exchange performance by lengthening the cutouts (6, 7, 8, 9, 10, 11, 12, 13) so as to form a front edge of a boundary layer. Further, it is possible to uniformly distribute the velocity of the air flow through the cutouts (6,7,8,9) by endowing the windward angle(α) to the leg portions (16', 17', 18', 19', 20') of the cutouts (6, 7,8,9) with the air passage flowed in the center portion of the hole inserted by the heat transfer tube 3. The center part of the cutouts (6,7) formed on the most windward side of the cutouts (6,7,8,9) includes the flat portion 13*a* so as to strengthen the plate-shaped fin 1 and distribute the velocity of the air flow uniformly.

Further, the cutouts formed on the next row on the most windward side of the cutouts (6,7,8,9) have the leeward side angle(β) so that the air flows smoothly after the air passes the cutouts (6,7,8,9) on the most windward side. In addition, the cutouts (10,11,12,13) on the leeward side are comprised symmetrically to the cutouts (6,7,8,9) on the windward side on the basis of the heat transfer tube 3, and the center part of the cutouts (12,13) on the last row on the leeward side of the cutouts (10,11,12,13) includes the plat portion 13*a* having the similar angle(α) to the leeward side angle(β).

Accordingly, it is advantageous to reduce the dead water region occurring behind the heat transfer tube 3 because the air A flows to the rear of heat transfer tube 3 by the leg portions (16', 17', 18', 19', 20', 21', 22', 23', 24', 25', 26', 27') formed by adjusting the windward side angle(α) and the leeward side angle(β) differently or equally.

The air flowing in through the openings of the cutouts (6,7) located on the most windward side flows out through the openings of the cutouts (12,13) located on the first leeward side due to the large volume and high speed. Likewise, the air flowing in through the openings of the cutouts (8,9) located on the most leeward side flows out through the openings of the cutouts (10,11) located on the first leeward side due to the small volume and low speed.

Further, the center part 6*a* formed on the windward side uniforms the passage area flowed in and strengthens the plate-shaped fin 1, as shown in FIG. 3(A) and FIG. 3(B), the center part 13*a* is comprised so as to adjust the air velocity on the leeward side equal to the distribution of the velocity of the air flow and reduce the dead water region occurred behind the heat transfer tube 3 by endowing the direction of the air so that it is possible to flow in efficiently on the next heat transfer tube 3 and the group of the cutouts.

In addition, the air flows smoothly since the air velocity slope is relatively slowly formed by the windward side angle(α), leeward side angle(β), and leg portions (16'–27') forming the circular arc inserted by the heat transfer tube 3.

Figure 5A:
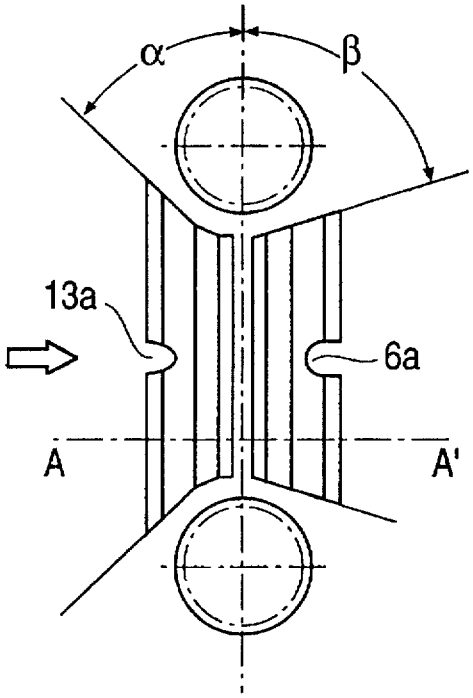
FIG. 5(A) is a fragmentary side elevational view of a fin tube heat exchanger according to a another embodiment of the present invention.
Figure 5B:
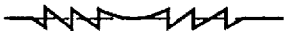
FIG. 5(B) is a section taken along the line A–A' in FIG. 5(A)

FIG. 5(A) and FIG. 5(B) depict another embodiment of the present invention, in which the windward side angle(α) is less than the leeward side angle(β), and the group of cutouts are comprised in exchange on the windward side and the leeward side.

Figure 6A:
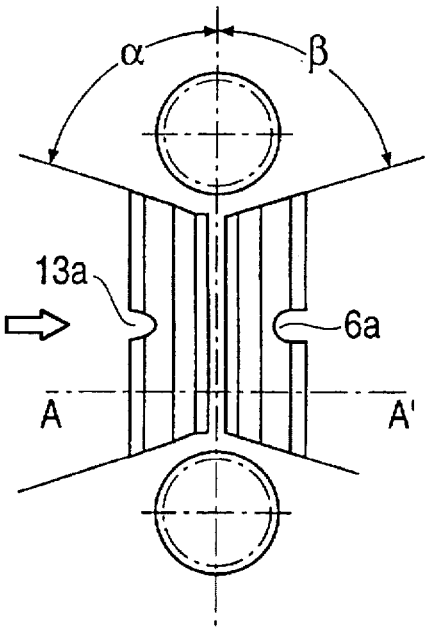
FIG. 6(A) is a fragmentary side elevational view of a fin tube heat exchanger according to a further embodiment of the present invention.
Figure 6B:
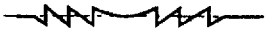
FIG. 6(B) is a section taken along the line A–A' in FIG. 6(A)

FIG. 6(A) and FIG. 6(B) depict further embodiment of the present invention, in which the windward side angle(α) is equal to the leeward side angle(β), and the group of cutouts are comprised in exchange on the windward side and the leeward side according to the air velocity.

Accordingly, in the present invention, it is possible to comprise the windward side angle being most suitable according to the heat exchange quantity upon the cutouts and to install the leeward side angle being suitable for increasing the effective heat exchange area by reducing the dead water region occurred behind the heat transfer tube, and to efficiently contact the air with the leg portions by increasing the contacted area since the windward side angle and the leeward side angle form the leg portions following the circular arc inserted by the heat transfer tube, so that high performance is attained.

While specific embodiments of the invention have been illustrated and described wherein, it is to realize that modifications and changes will occur to those skilled in the art. It is therefore to be understood that the appended claims are intended to cover all modifications and changes as fall within the true spirit and scope of the invention.

What is claimed is:

1. A fin tube heat exchanger comprising;

a plurality of plate-shaped fins at regular intervals in parallel with one another through which air flows;

a plurality of heat transfer tubes extending through said plate-shaped fins; and a group of cutouts being formed in said plate-shaped fins to partially surround said heat transfer tubes, said group of cutouts being divided into a windward subgroup and a leeward subgroup as viewed in a direction of air flow, with a center line passing through a center of each of said tubes serving as a boundary therebetween, and a central flat portion being provided which is located along said center line and between said windward subgroup and said leeward subgroup;

said windward subgroup being formed by at least two inclined slats which project from a surface of said plate-shaped fin at a non-zero angle with respect to the surface of the plate-shaped fin, said inclined slats immediately bordering one another, said inclined slats progressively increasing in length proceeding in a direction away from said center line such that end portions of said inclined slats form a windward side angle with respect to said center line;

said leeward subgroup being formed by at least two inclined slats which project from a surface of said plate-shaped fin at a non-zero angle with respect to the surface of the plate-shaped fin in a direction opposite to that of said inclined slats of said windward subgroup, said inclined slats of said leeward subgroup immediately bordering one another, said inclined slats of said leeward subgroup progressively increasing in length proceeding in a direction away from said center line such that end portions of said inclined slats of said leeward subgroup form a leeward side angle with respect to said center line, wherein each of outermost ones of said slats on said windward side and said leeward side are divided approximately in half by a central flat portion, and a substantially semicircle-shaped notch portion is formed on a central portion of slats which are located next to said outermost ones of said slats on the windward side and the leeward side.

2. The fin tube heat exchanger as set forth in claim 1, wherein said windward side angle is larger than said leeward side angle.

3. The fin tube heat exchanger as set forth in claim 1, wherein said windward side angle is equal to said leeward side angle.

4. The fin tube heat exchanger as set forth in claim 1, wherein said windward side angle is smaller than said leeward side angle.

5. The fin tube heat exchanger as set forth in claim 1, wherein the number of slats which form said windward subgroup is four.

* * * * *